US008531377B2

(12) United States Patent
Kotani et al.

(10) Patent No.: US 8,531,377 B2
(45) Date of Patent: Sep. 10, 2013

(54) LIQUID CRYSTAL DISPLAY DEVICE HAVING DRIVE CIRCUITS WITH MASTER/SLAVE CONTROL

(75) Inventors: Yoshihiro Kotani, Chiba (JP); Kenichi Akiyama, Mobara (JP)

(73) Assignees: Hitachi Displays, Ltd., Chiba-ken (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 822 days.

(21) Appl. No.: 12/292,447

(22) Filed: Nov. 19, 2008

(65) Prior Publication Data

US 2009/0231324 A1 Sep. 17, 2009

(30) Foreign Application Priority Data

Mar. 11, 2008 (JP) ..... 2008-060947

(51) Int. Cl.
*G09G 3/36* (2006.01)

(52) U.S. Cl.
USPC ..... 345/100

(58) Field of Classification Search
USPC ..... 345/103, 98–100; 349/149, 152
See application file for complete search history.

(56) References Cited

U.S. PATENT DOCUMENTS

| | | | | |
|---|---|---|---|---|
| 6,937,216 | B1 * | 8/2005 | Ishiyama | 345/103 |
| 7,106,295 | B2 | 9/2006 | Watanabe et al. | |
| 2003/0090614 | A1 * | 5/2003 | Kim et al. | 349/149 |
| 2007/0013639 | A1 * | 1/2007 | Lin et al. | 345/100 |

FOREIGN PATENT DOCUMENTS

| | | |
|---|---|---|
| JP | 2003-270660 | 3/2002 |

* cited by examiner

*Primary Examiner* — Allison Walthall
(74) *Attorney, Agent, or Firm* — Stites & Harbison PLLC; Juan Carlos A. Marquez

(57) ABSTRACT

A liquid crystal display device used in miniaturized portable equipment includes a distribution circuit to cope with a high-definition multi-grayscale display. A distribution circuit distributes an output of a drive circuit to a plurality of video signal lines within one scanning period, the distribution circuit being divided into a plurality of distribution circuits, and control signals being supplied to each distribution circuit from both end portions of each distribution circuit. When an output part of the drive circuit is configured such that a high withstand-voltage output amplifier and a low withstand-voltage output amplifier are alternately connected with the distribution circuit, a master function and a slave function are imparted to the drive circuit so as to allow the drive circuit to cope with odd-numbered outputs.

11 Claims, 12 Drawing Sheets

LIQUID CRYSTAL DISPLAY DEVICE HAVING DRIVE CIRCUITS WITH MASTER/SLAVE CONTROL

The present application claims priority from Japanese application JP2008-60947 filed on Mar. 11, 2008, the content of which is hereby incorporated by reference into this application.

BACKGROUND OF THE INVENTION

1. Field of the Invention

The present invention relates to a liquid crystal display device, and more particularly to a technique which is effectively applicable to a drive circuit of a liquid crystal display device used in a display part of a portable device.

2. Description of the Related Art

A TFT (Thin Film Transistor)-type liquid crystal display device has been popularly used as a display device of a personal computer, a television receiver set or the like. Such a liquid crystal display device includes a liquid crystal display panel and a drive circuit for driving the liquid crystal display panel.

With respect to such a liquid crystal display device, a miniaturized liquid crystal display device has been popularly used as a display device of portable equipment such as a mobile phone. Further, recently, there has been a demand for the application of a liquid crystal display device in a display device of a portable computer.

JP-A-2003-270660 (patent document 1) discloses a liquid crystal display panel in which a distribution circuit is formed on a substrate, and video signals outputted from a drive circuit are distributed to a plurality of video signal lines using the distribution circuit thus reducing the number of outputs of the drive circuit whereby a circuit scale can be suppressed.

However, patent document 1 fails to disclose any drawbacks that the use of the distribution circuit in a high-definition display device brings about.

SUMMARY OF THE INVENTION

Also with respect to a display device used in a portable computer, there has been a demand for a display device which can perform a high-definition multi-grayscale display. To satisfy such a demand, a high-definition display device which exhibits high display quality is used in portable equipment.

However, to perform a high-definition multi-grayscale display with a portable liquid crystal display device having a limited display region, it is necessary to increase a circuit scale of a drive circuit. In this case, mounting of the drive circuit in the portable liquid crystal display device becomes difficult.

Accordingly, with respect to the liquid crystal display device for portable equipment, there has been adopted a method which can suppress the circuit scale of the drive circuit by mounting a distribution circuit which can distribute an output from the drive circuit into a plurality of video signal lines on a liquid crystal display panel. However, recently, it has becomes difficult for such a method which uses the distribution circuit to cope with the increase of a scale of the drive circuit mounted on the liquid crystal display panel. Further, a demand for dot inversion driving for enhancing display quality is also increasing.

The present invention has been made to overcome the above-mentioned drawbacks of the related art, and it is an object of the present invention to provide a liquid crystal display device for portable equipment which can cope with the increase of a circuit scale of the liquid crystal display device and can perform a high-quality display.

The above-mentioned and other objects and novel features of the present invention will become apparent from the description of this specification and attached drawings.

To briefly explain the summary of typical inventions among the inventions disclosed in this specification, they are as follows.

A liquid crystal display device of the present invention includes two substrates, liquid crystal composition which is sandwiched between the two substrates, a plurality of pixels which is mounted on the substrate, a plurality of pixel electrodes each of which are formed in the pixel, a counter electrode which faces the pixel electrodes, a plurality of switching elements each of which is mounted on the pixel electrode, a plurality of video signal lines which are configured to supply video signals to the switching elements, a plurality of scanning signal lines which are configured to supply scanning signals for controlling turning on and off of the switching elements, and a drive circuit which outputs the video signals to the video signal lines and outputs the scanning signals to the scanning signal line.

On the substrate on which the pixels are formed, a distribution circuit which distributes an output of the drive circuit to the plurality of video signal lines is formed. A control signal for controlling the distribution circuit is supplied to the distribution circuit from both ends of the distribution circuit.

The distribution circuit and the drive circuit are respectively divided into two, wherein a function of a master circuit and a function of a slave circuit are imparted to the drive circuit, and the drive circuit can be formed into the master circuit or the slave circuit in response to a control signal from the outside.

To briefly explain advantageous effects obtained by the typical inventions among the inventions disclosed in this specification, they are as follows.

According to the present invention, by supplying the control signal to the distribution circuit for controlling the distribution circuit from both ends of the distribution circuit, it is possible to reduce rounding of waveform of the control signal attributed to the increase of a scale size of the distribution circuit.

Further, by providing a plurality of distribution circuits and a plurality of drive circuits, the present invention provides a high-definition liquid crystal display device which can increase the number of video signal lines. Still further, by imparting the function of the master circuit and the function of the slave circuit to the drive circuit, the present invention can cope with a plurality of circuit constitutions.

DESCRIPTION OF THE PREFERRED EMBODIMENTS

Hereinafter, embodiments of the present invention are explained in detail in conjunction with drawings.

Here, in all drawings for explaining the embodiments, parts having identical functions are given same numerals and their repeated explanation is omitted.

Figure 1:
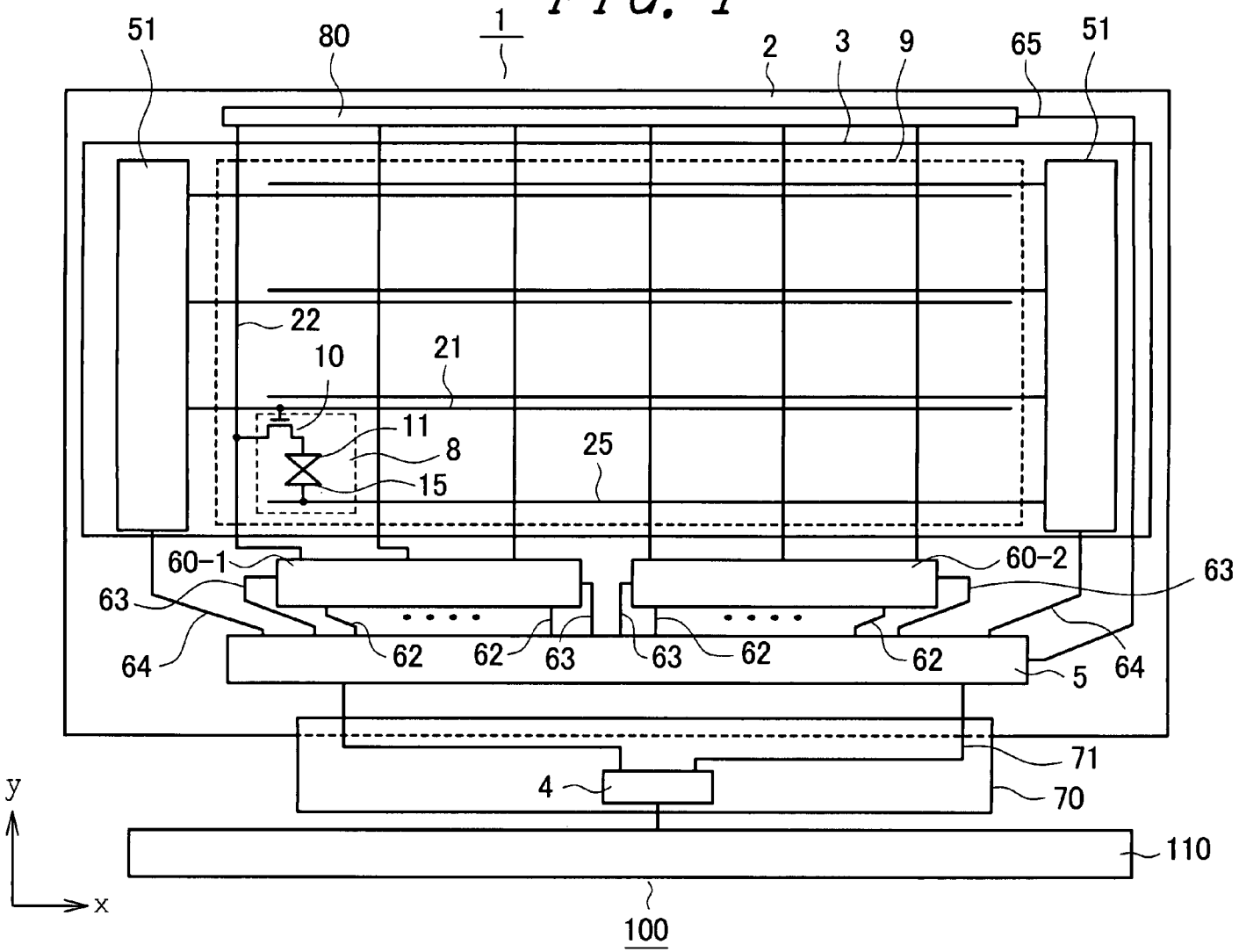
FIG. 1 is a schematic block diagram showing a liquid crystal display device of an embodiment according to the present invention.

FIG. 1 is a block diagram showing the basic constitution of a liquid crystal display device of an embodiment according to the present invention. As shown in FIG. 1, a liquid crystal display device 100 of this embodiment is constituted of a liquid crystal display panel 1, a drive circuit 5, a flexible printed circuit board 70, a backlight 110 and a housing casing (not shown in the drawing).

The liquid crystal display panel 1 is configured as follows. A TFT substrate 2 on which a plurality of thin film transistors 10, a plurality of pixel electrodes 11, a plurality of counter electrodes 15 and the like are formed and a color filter substrate 3 on which a plurality of color filters and the like are formed are overlapped with each other with a predetermined gap therebetween. The substrates are adhered to each other using a frame-shaped sealing material (not shown in the drawing) arranged between the substrates in the vicinity of peripheral portions thereof, and at the same time, liquid crystal composition is filled and sealed in a space defined by the both substrate and the sealing material. Further, a polarizer is adhered to the outer surfaces of the both substrates.

Here, the embodiment of the present invention is applicable to both of a so-called IPS-method type liquid crystal display panel in which the counter electrodes 15 are arranged on the TFT substrate 2 and a so-called vertical-electric-field method type liquid crystal display panel in which the counter electrodes 15 are arranged on the color filter substrate 3 in the same manner.

On the TFT substrate 2, a plurality of scanning signal lines (also referred to as gate lines) 21 which extend in the x direction and are arranged parallel to each other in the y direction in the drawing and a plurality of video signal lines (also referred to as drain signal lines) 22 which extend in the y direction and are arranged parallel to each other in the x direction in the drawing are formed, and a pixel portion 8 is formed in each of the regions which are surrounded by the scanning signal lines 21 and the video signal lines 22.

Here, although the liquid crystal display panel 1 includes a large number of pixel portions 8 in a matrix array, for facilitating the understanding of the drawing, only one pixel portion 8 is shown in FIG. 1. The pixel portions 8 arranged in a matrix array form a display region 9, the respective pixel portions 8 play a role of pixels of a display image, and an image is displayed in the display region 9.

The thin film transistor 10 of each pixel portion 8 has a source thereof connected to the pixel electrode 11, a drain thereof connected to the video signal line 22, and a gate thereof connected to the scanning signal line 21. The thin film transistor 10 functions as a switch for supplying a display voltage (grayscale voltage) to the pixel electrode 11. Here, although naming of "source" and "drain" may be reversed depending on biases, the terminal which is connected to the video signal line 22 is referred to as the drain in this embodiment.

The drive circuit 5 is arranged on a transparent insulation substrate (glass substrate, resin substrate or the like) which constitutes the TFT substrate 2. The drive circuit 5 is connected to a distribution circuit 60 by relay signal lines 62, and video signals outputted from the drive circuit 5 are inputted to the distribution circuit 60 via a large number of relay signal lines 62. Further, control signal lines 63 extend from the drive circuit 5 to the distribution circuit 60.

In FIG. 1, the distribution circuit 60 is formed by being divided into distribution circuits 60-1 and 60-2. In addition to the control signal lines 63 from the outside, the control signal lines 63 are connected to the respective distribution circuits 60-1 and 60-2 from the inside which is arranged between the two distribution circuits 60-1 and 60-2. By supplying the control signal to the distribution circuit 60 from both ends of the distribution circuit 60 via the control signal lines 63, it is possible to prevent a drawback that lengthening of the control signal line in the inside of the distribution circuit 60 makes the rounding of the waveform of the control signal.

Further, the drive circuit 5 and scanning signal line drive circuits 51 are connected with each other by signal lines 64, and the drive circuit 5 and an equalizer circuit 80 are electrically connected with each other by a signal line 65. In FIG. 1, one of the scanning signal line drive circuit 51 supplies a scanning signal to the scanning signal lines 21, and another scanning signal line drive circuit 51 supplies a common voltage to counter electrodes (common electrodes) 25.

A flexible printed circuit board 70 is connected to a long side of the TFT substrate 2. The flexible printed circuit board 70A includes a connector 4. The connector 4 is connected to an external signal line so as to allow inputting of signals to the flexible printed circuit board 70 from the outside. Lines 71 are provided between the connector 4 and the drive circuit 5, and the signals from the outside are inputted to the drive circuit 5 via the lines 71.

The liquid crystal display panel 1 is a non-light emitting element and hence, requires a light source for displaying images. For this end, the liquid crystal display device 100 includes a backlight 110, and the backlight 110 emits light to the liquid crystal display panel 1. The liquid crystal display panel 1 performs a display by controlling a transmission quantity or a reflection quantity of light radiated from the backlight 110. Here, although the backlight 110 is arranged on a back surface or a front surface of the liquid crystal display panel 1, to facilitate the understanding of the drawing, the backlight 110 is illustrated to be juxtaposed to the liquid crystal display panel 1 in FIG. 1.

A control signal transmitted from a control device (not shown in the drawing) arranged outside the liquid crystal display device 100 and a power source voltage supplied from an external power source circuit (not shown in the drawing) are inputted to the drive circuit 5 via the connector 4 and the lines 71.

Signals inputted to the drive circuit 5 from the outside are control signals including a clock signal, a display timing signal, a horizontal synchronizing signal, a vertical synchronizing signal and the like, display-use data (R-G-B) and a display mode control command. The drive circuit 5 drives the liquid crystal display panel 1 in response to the inputted signals.

To drive the scanning signal lines 21, the drive circuit 5 supplies control signals to the scanning signal line drive circuits 51 via the control signal lines 64. The scanning signal line drive circuit 51, based on a reference clock generated inside the drive circuit 5, supplies a selection voltage (scanning signal) of "High" level (hereinafter also referred to as a High signal) to the scanning signal lines 21 every 1 horizontal scanning period. Due to such an operation, the plurality of thin film transistors 10 connected to the respective scanning signal lines 21 of the liquid crystal display panel 1 allow the electrical conduction between the video signal lines 22 and the pixel electrodes 11 for 1 horizontal scanning period.

Further, the drive circuit 5 outputs a grayscale voltage (video signal) corresponding to a grayscale to be displayed by the pixel to the relay signal lines 62. When the grayscale voltage is supplied to the video signal lines 22 via the distribution circuit 60, the grayscale voltage is supplied to the pixel electrodes 11 from the video signal lines 22 via the thin film transistors 10 in an ON (conductive) state. Thereafter, when the thin film transistors 10 are brought into an OFF state, the grayscale voltage based on a video to be displayed by the pixels is held in the pixel electrodes 11. The detail of the distribution circuit 60 is described later.

Figure 2:
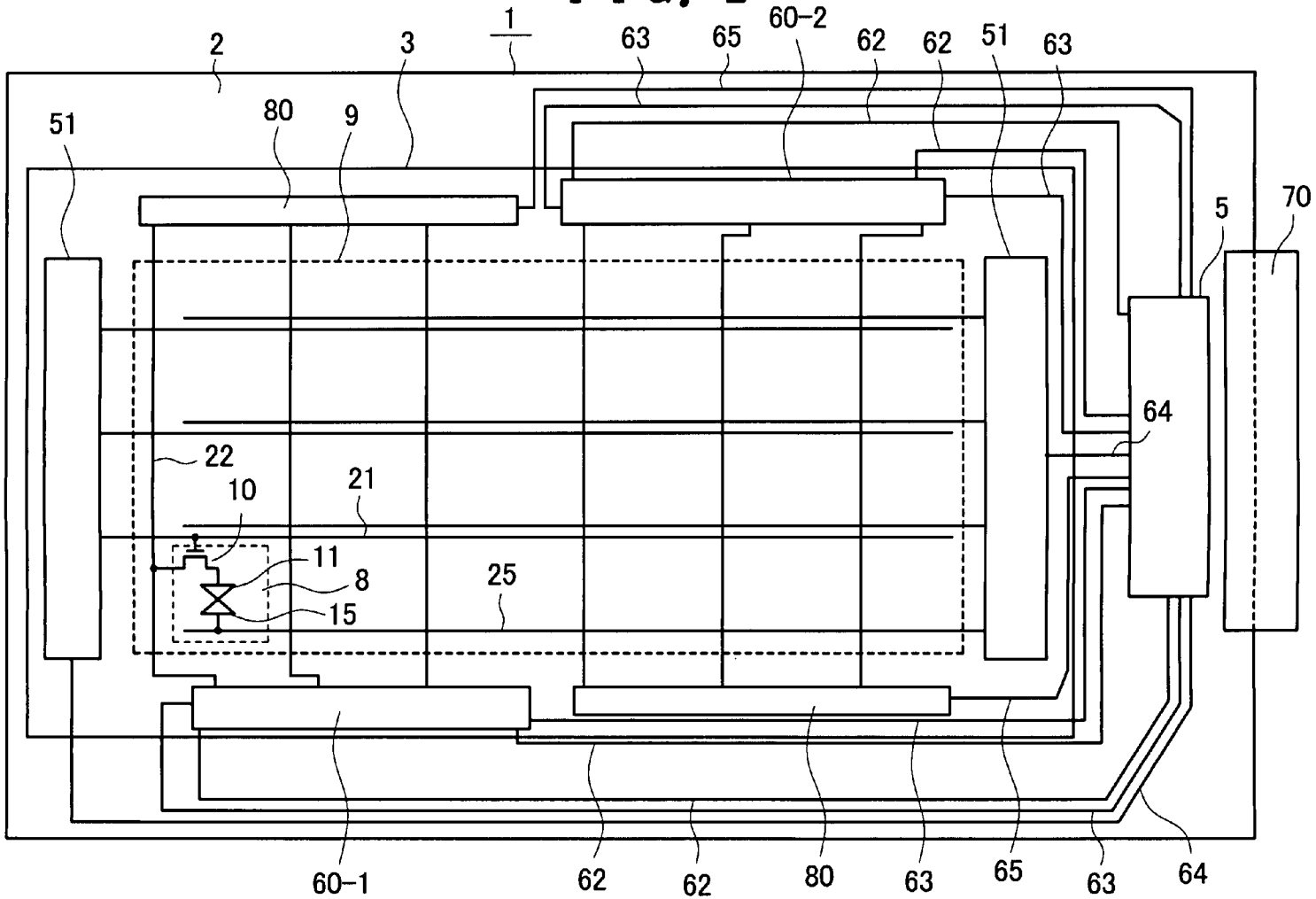
FIG. 2 is a schematic block diagram showing the liquid crystal display device of the embodiment according to the present invention.

Next, FIG. 2 shows a case in which the drive circuit 5 is arranged in a juxtaposed manner with the scanning signal line drive circuits 51. As shown in FIG. 2, by arranging the drive circuit 5 on a short side of the liquid crystal display panel 1, it is possible to pull out the flexible printed circuit board 70 from the short side of the liquid crystal display panel 1.

Also in a case where the drive circuit 5 is mounted on the short side of the liquid crystal display panel 1 as shown in FIG. 2, the drive circuit 5 and the distribution circuits 60-1 and 60-2 are connected with each other by the control signal lines 63, and the control signal lines 63 allows the inputting of control signals to the distribution circuits 60-1 and 60-2 via the both end portions of the respective distribution circuits 60-1 and 60-2.

In FIG. 2, the distribution circuit 60 is divided into two parts, the divided distribution circuits 60-1, 60-2, which are arranged on lower and upper sides of the liquid crystal display panel 1, respectively. A distance from the drive circuit 5 to the distribution circuit 60-1 in FIG. 2 is set longer compared to a distance from the drive circuit 5 to the distribution circuit 60-1 in FIG. 1. Accordingly, in the case, inputting of the control signals to the distribution circuit 60 from the both ends thereof via the control signal lines 63 is more effective to cope with rounding of waveform. In the case shown in FIG. 2, the equalizer circuit 80 is also divided into two parts.

Figure 3:
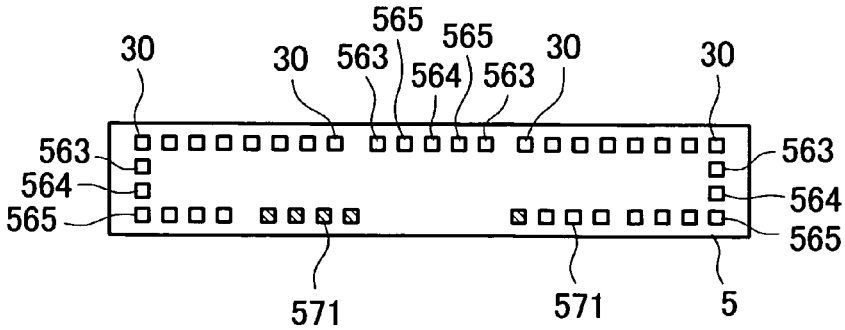
FIG. 3 is a schematic plan view showing a terminal part of a drive circuit used in the liquid crystal display device of the embodiment according to the present invention.

Next, FIG. 3 shows the arrangement of output terminals formed on the drive circuit 5. FIG. 3 shows the arrangement of the output terminals for supplying control signals to both ends of the distribution circuit 60 via the control signal lines 63. As shown in FIG. 1 and FIG. 2, a large number of signal lines are connected to the drive circuit 5. Among these lines, a large number of relay signal lines 62 from which the video signals are outputted are connected between the drive circuit 5 and the distribution circuit 60, and a large number of output terminals 30 which are connected to the relay signal lines 62 are formed on the drive circuit 5.

Connection terminals 563 to be connected to the control signal lines 63 are formed on the drive circuit 5 at both ends of the output terminals 30. To supply the control signals to both ends of the distribution circuit 60 particularly, it is effective to arrange the output terminals 563 at portions of the drive circuit 5 adjacent to both ends of the output terminals 30. Further, by providing the output terminal 563 between two output terminals 30 and at a center portion of the drive circuit 5, even when the distribution circuit 60 is divided into two parts, the drive circuit 5 can properly output control signals to the distribution circuit 60.

At the center portion of the drive circuit 5, corresponding to the arrangement of the drive circuit 5 on the short side of the liquid crystal display panel 1 shown in FIG. 2, an output terminal 564 which is connected to the scanning signal line drive circuit 51 is provided inside the output terminals 565 which are connected to the equalizer circuit 80.

Further, at respective end portions of the drive circuit 5, corresponding to the arrangement of the drive circuit 5 shown in FIG. 1, to allow the arrangement of the signal line 65 outside the signal lines 64, the output terminal 565 which is connected to the equalizer circuit 80 is provided outside the output terminal 564 which is connected to the scanning signal line drive circuit 51. Here, numeral 571 indicates input terminals.

Figure 4:
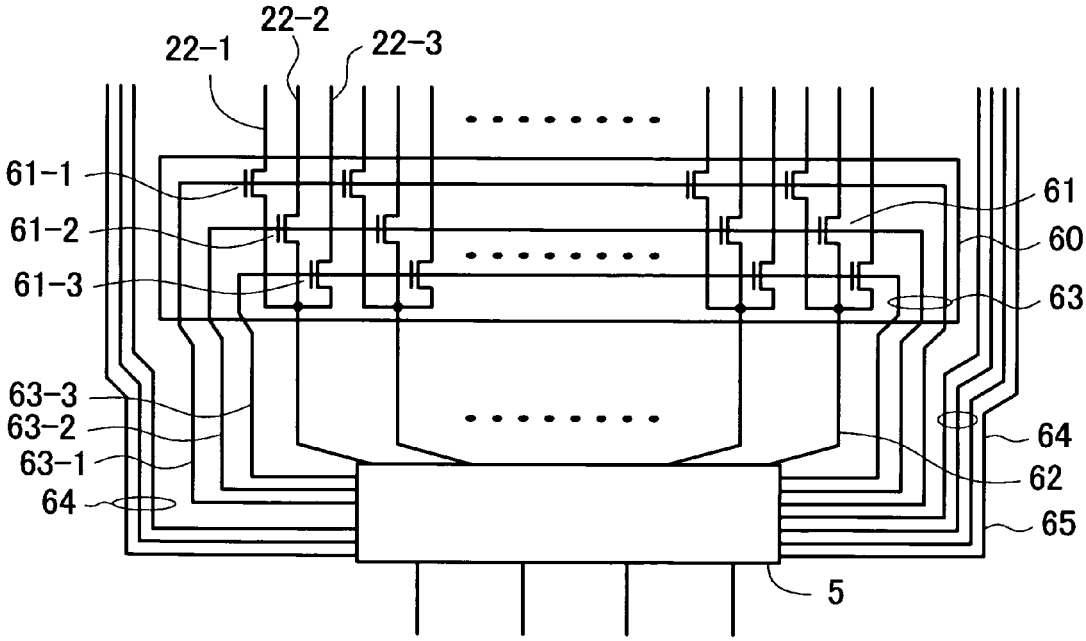
FIG. 4 is a schematic block diagram showing a distribution circuit of the liquid crystal display device of the embodiment according to the present invention.

Next, FIG. 4 shows the distribution circuit 60. The video signals outputted from the drive circuit 5 are supplied to the distribution circuit 60 via the relay signal lines 62. Switching elements 61 which allow the connection between the distribution circuit 60 and the video signal lines 22 are incorporated in the distribution circuit 60.

Figure 5:
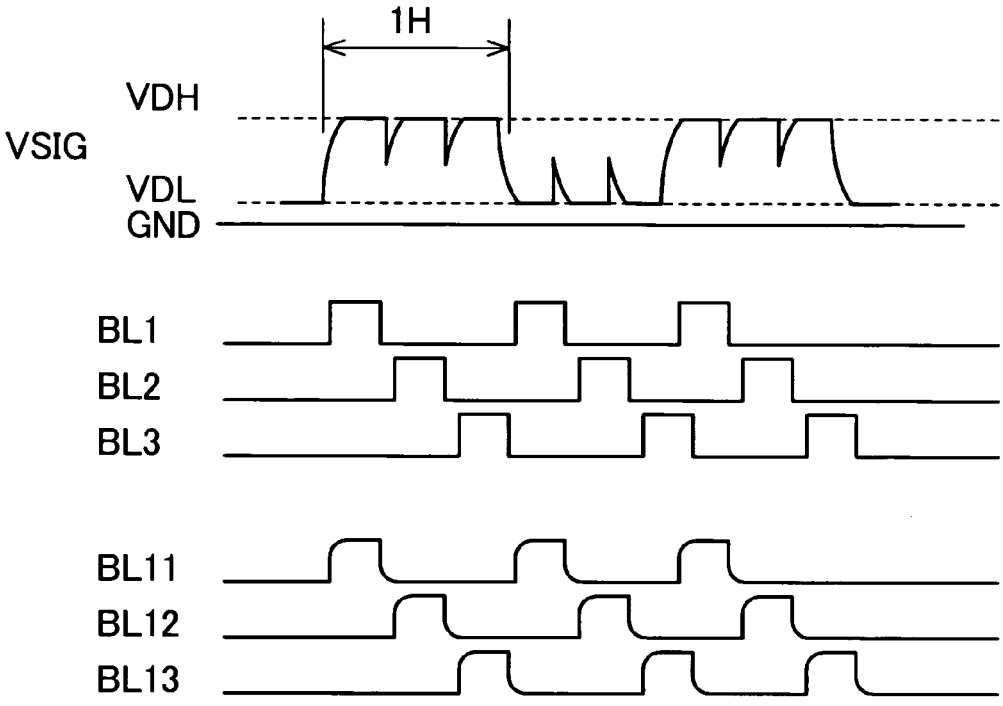
FIG. 5 is a timing chart showing a driving method of the distribution circuit of the liquid crystal display device of the embodiment according to the present invention.

FIG. 5 is a timing chart for explaining a driving method of the distribution circuit 60. Symbol VSIG indicates a video signal outputted to the relay signal lines 62 from the drive circuit 5. Symbol BL indicates a control signal outputted to the control signal lines 63 from the drive circuit 5. A control signal BL1 is outputted to a control signal line 63-1, a control signal BL2 is outputted to a control signal line 63-2, and a control signal BL3 is outputted to a control signal line 63-3. Here, symbols BL11, BL12 and BL13 indicate control signals in which rounding of waveform is generated.

As shown in FIG. 5, during 1 horizontal scanning period (1H) in which the scanning signal is a High signal, the video signal VSIG to be supplied to the plurality of video signal lines is outputted to the respective relay signal lines 62. The video signals VSIG output voltages ranging from a maximum voltage level VDH to a minimum voltage level VDL corresponding to the grayscales displayed on the respective pixels. The distribution circuit 60 shown in FIG. 4 is configured to distribute the video signals VSIG to three video signal lines 22, and the three control signals BL, provide High signals by turns to bring three switching elements 61 into an ON state.

First of all, when the control signal BL1 is outputted to the control signal line 63-1, the switching element 61-1 assumes an ON state, and video signals are supplied to the video signal line 22-1. Thereafter, sequentially, the control signal BL2 allows the switching element 61-2 to assume an ON state via the control signal line 63-2 so that video signals are supplied to the video signal line 22-2. In the same manner, the video signals are supplied to the video signal line 22-3 in response to the control signal BL3.

In driving the distribution circuit 60, when a routing distance of the control signal line 63 is elongated, rounding of waveform is generated on end portions of the control signal lines 63 as indicated by waveforms of control signals BL11, BL12, BL13. Accordingly, as shown in FIG. 1 and FIG. 2, it is effective to supply the control signals to the distribution circuit 60 from both end portions of the distribution circuit 60.

Figure 6:
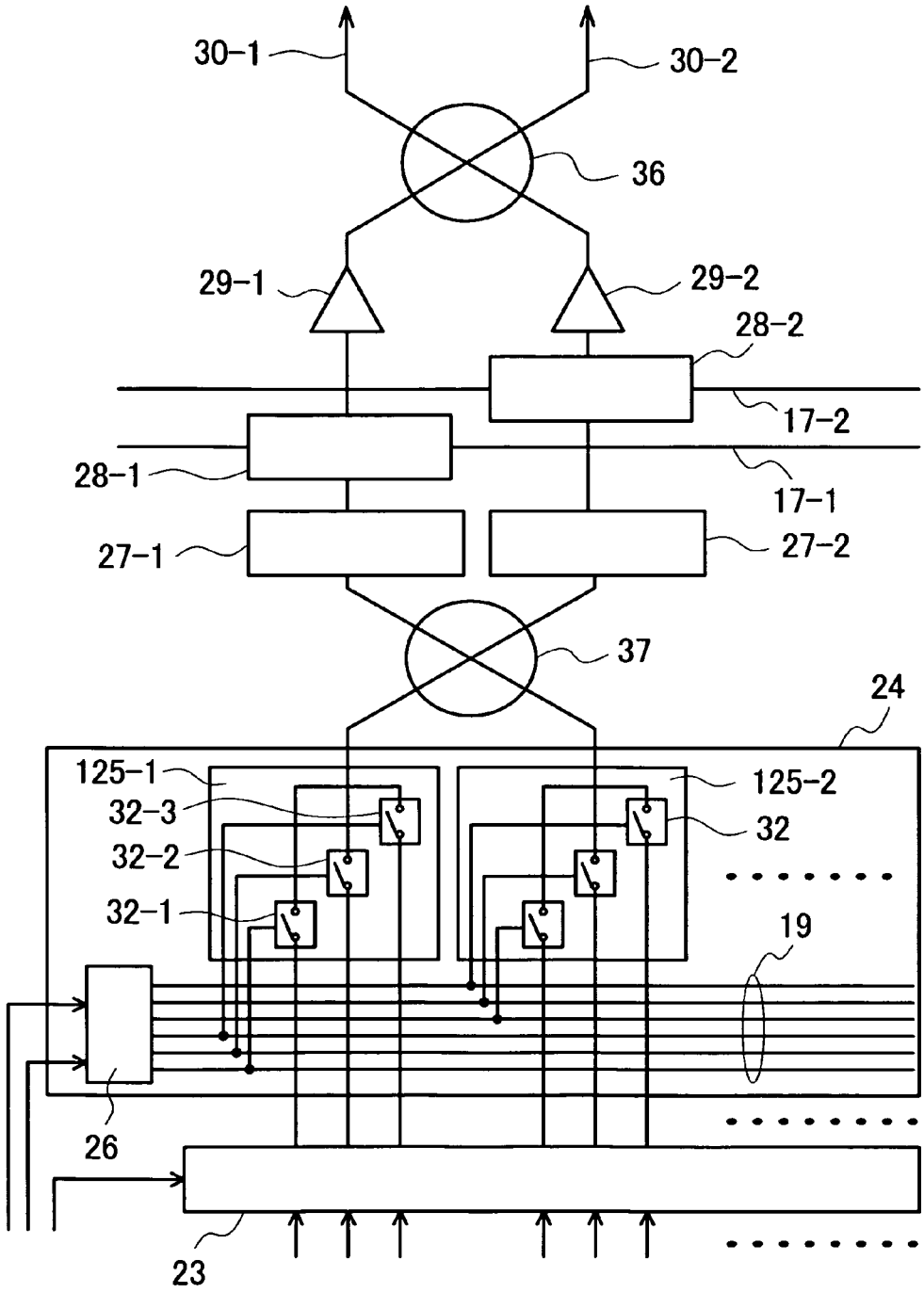
FIG. 6 is a schematic block diagram showing an output part of the drive circuit of the liquid crystal display device of the embodiment according to the present invention.

Next, in conjunction with FIG. 6, explanation is made with respect to the constitution in which a video signal of positive polarity and a video signal of negative polarity are alternately outputted, and the video signal is supplied from the drive circuit 5 after divided as shown in FIG. 5. FIG. 6 shows output parts of adjacent two output terminals 30-1 and 30-2 of the drive circuit 5. Numeral 29-1 indicates a high withstand-voltage output amplifier and numeral 29-2 indicates a low withstand-voltage output amplifier. In AC driving, when a voltage of the counter electrode (hereinafter, referred to as a common voltage) is set to a fixed value, a video signal of positive polarity (hereinafter, also referred to as a lower grayscale voltage) is applied to the common voltage and a grayscale voltage of negative polarity is applied to the pixel electrode 11. In a circuit shown in FIG. 6, a grayscale voltage of positive polarity is outputted from the high withstand-voltage output amplifier 29-1 and a grayscale voltage of negative polarity is outputted from the low withstand-voltage output amplifier 29-2.

In FIG. 6, in outputting the grayscale voltage, the high withstand-voltage output amplifier 29-1 and the low withstand-voltage output amplifier 29-2 are changed over by a changeover switch 36. To output a grayscale voltage of positive polarity from the output terminal 30-1, the changeover switch 36 connects the high withstand-voltage output amplifier 29-1 and the output terminal 30-1 with each other. Another output terminal 30-2 is connected to the low withstand-voltage output amplifier 29-2 and outputs a grayscale voltage of negative polarity.

On the other hand, the order of the display data is also changeable and the changeover switch 37 changes over the output of the data line selection circuit 125 to connect it to the level shifter circuit 27. That is, with the use of the changeover switch 37, the data line selection circuit 125-1 is connectable to both of the level shifter circuits 27-1 and 27-2.

Accordingly, when the grayscale voltage of positive polarity is outputted as the display data to be outputted from the selector circuit 24, the changeover switch 37 supplies the output of the selector switch 24 to the level shifter circuit 27-1, while when the grayscale voltage of negative polarity is outputted as the display data to be outputted from the selector circuit 24, the changeover switch 37 supplies the output of the selector circuit 24 to the level shifter circuit 27-2.

The selector circuit 24 outputs the display data to a decoder circuit 28 by time division. The selector circuit 24 includes a data line selection circuit 125 so that, in synchronism with a control signal supplied to the distribution circuit 60, a time division control signal is transmitted to the selector circuit 24. A time-division-signal generation circuit 26 forms a time division signal in response to the time division control signal and outputs the time division signal to time division signal lines 19.

The time division signal lines 19 are connected to the respective data lines election circuits 125. The time division signal inputted to the data line selection circuit 125 controls the data line selection circuit 125. The data line selection circuit 125 selects the display data to be outputted from a line latch circuit 23 in response to the time division signal, and outputs the display data to the level shifter circuit 27 at a next stage. That is, although the line latch circuit 23 outputs the display data for one horizontal scanning period (1H), the one scanning period is divided into a plurality of periods by the selector circuit 24 and different display data is transmitted every divided period to the level shifter circuit 27.

Figure 7:
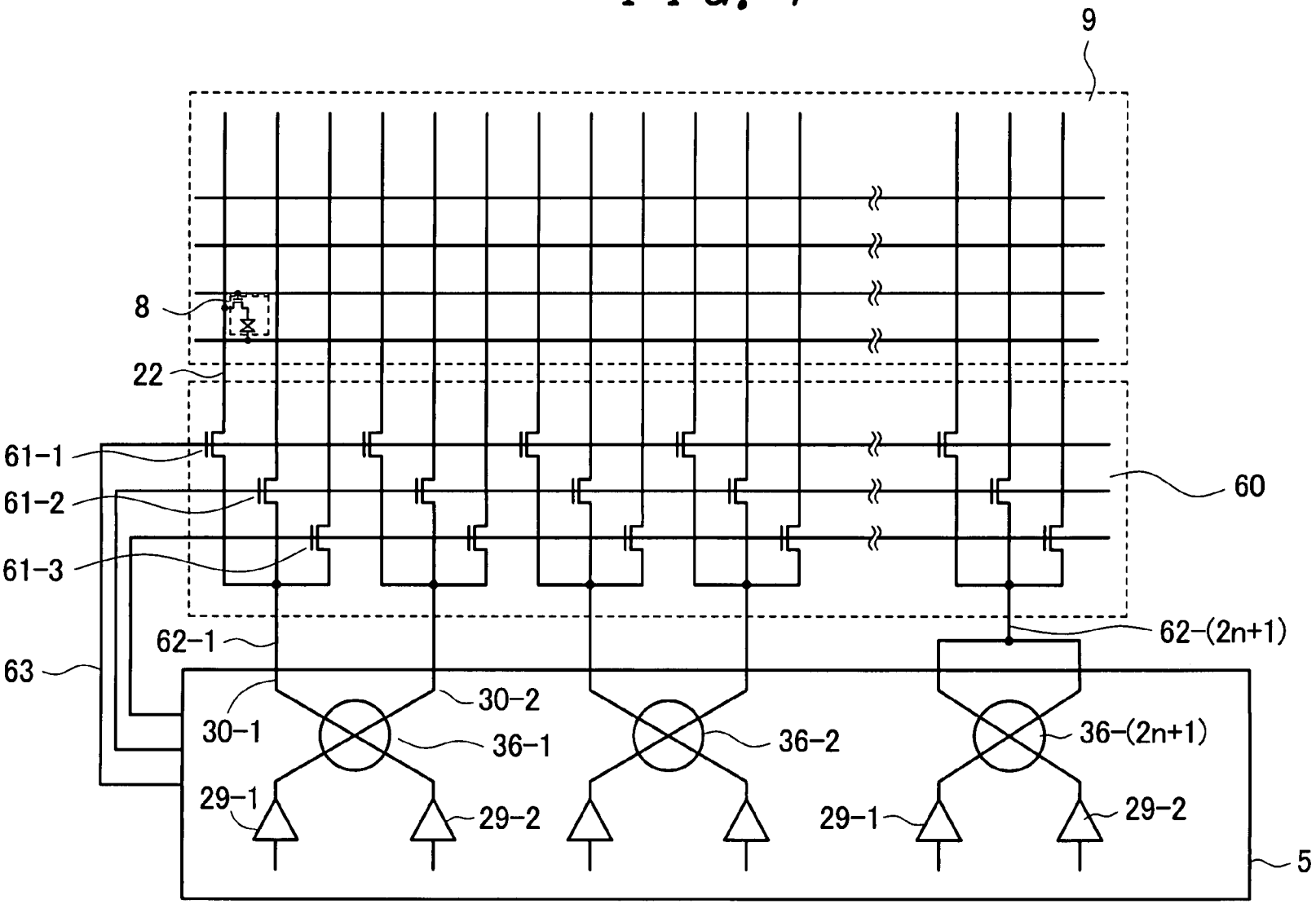
FIG. 7 is a schematic block diagram showing the distribution circuit of the liquid crystal display device of the embodiment according to the present invention.

Next, in conjunction with FIG. 7, a drawback which arises when the number of signal lines 62 is an odd number is explained.

In general, the number of video signal lines 22 formed on the liquid crystal display panel 1 is an even number. Further, since three lines R, G, B form a set, the number of relay signal lines 62 is also an even number. However, as shown in FIG. 1, when the distribution circuit 60 is constituted of the two distribution circuits 60-1, 60-2, the number of relay signal lines 62 which are connected to each distribution circuit 60 becomes an odd number. When the number of relay signal lines 62 is an odd number, as shown in FIG. 6, the drive circuit 5 alternately outputs the grayscale voltage of positive polarity and the grayscale voltage of negative polarity and hence, there arises a drawback that one output amplifier remains unconnected to the relay signal line in the output part at an outermost end.

Accordingly, as shown in FIG. 7, both output terminals of the last changeover switch 36-(2n+1) are connected to the signal line 62-(2n+1). Accordingly, with respect to the high withstand-voltage output amplifier 29-1 and a low withstand-voltage output amplifier 29-2 which are connected to the signal lines 62-(2n+1), for example, when the high withstand-voltage output amplifier 29-1 outputs the grayscale voltage to the signal line 62-(2n+1), the low withstand-voltage output amplifier 29-2 assumes a state of not being connected to the signal line 62-(2n+1).

Figure 8:
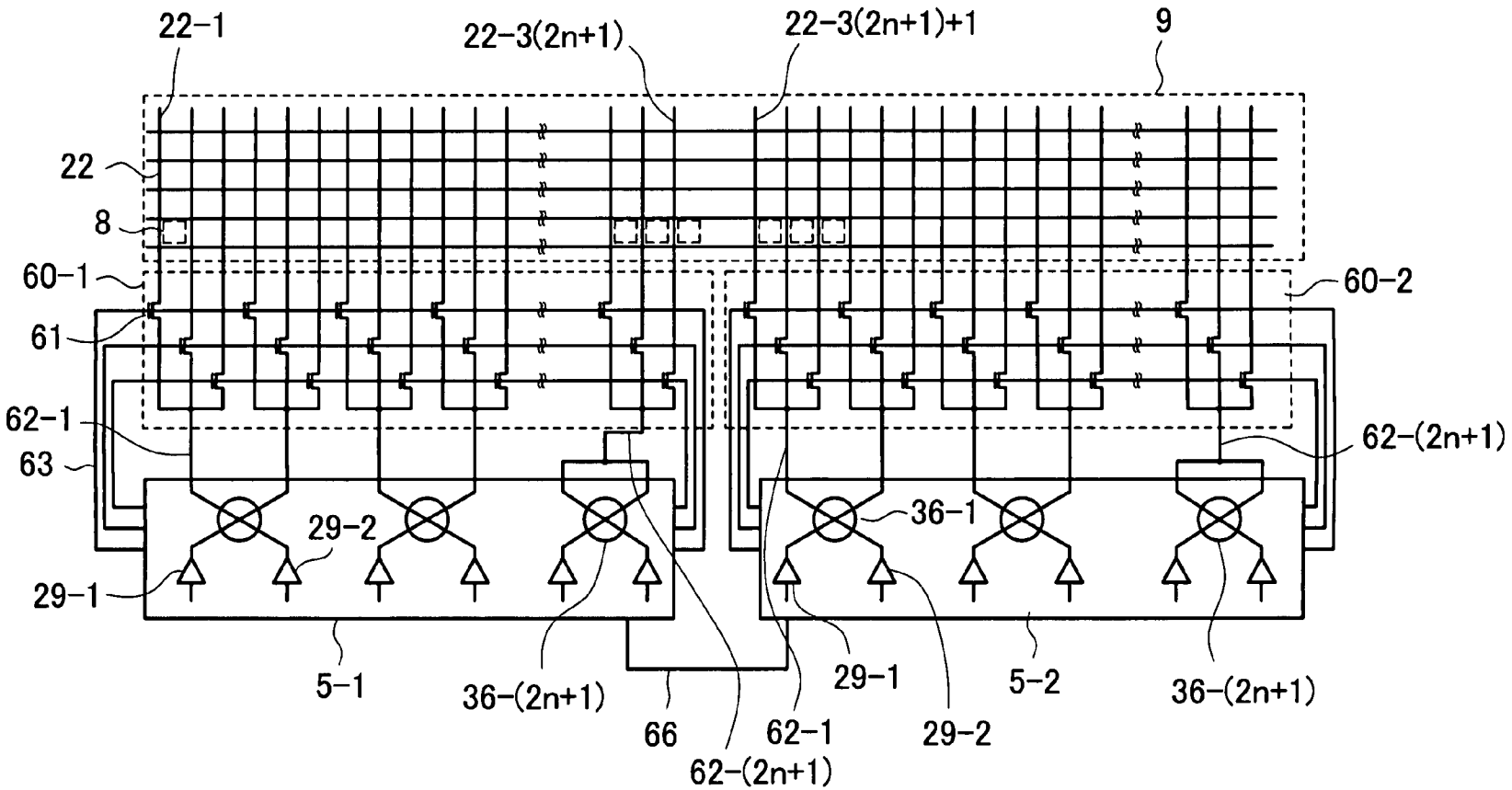
FIG. 8 is a schematic block diagram showing the distribution circuit of the liquid crystal display device of the embodiment according to the present invention.

FIG. 8 shows a drawback which arises when two drive circuits 5 which respectively output odd-numbered signals are arranged parallel to each other. As described above, along with the drive circuits 5-1 and 5-2, both of the output terminals of the last changeover switch 36-(2n+1) are connected to the signal line 62-(2n+1).

As described above, a grayscale voltage of positive polarity and a grayscale voltage of negative polarity are alternatively outputted and hence, when a (3×(2n+1))th video signal line 22-3 (2n+1) assumes positive polarity, for example, a grayscale voltage of negative polarity is supplied to a (3×(2n+1)+1)th video signal line 22-3 (2n+1).

Accordingly, at timing that the drive circuit 5-1 outputs the grayscale voltage of positive polarity to the first video signal line 22-1, the drive circuit 5-2 outputs the grayscale voltage of negative polarity to the video signal line 22-3 (2n+1)+1.

That is, the drive circuit 5 is divided into a drive circuit which starts outputting of the grayscale voltage of positive polarity and a drive circuit which starts outputting of the grayscale voltage of negative polarity. Here, a master function and a slave function are imparted to the drive circuit 5 such that the drive circuit 5 to which the master function is imparted starts outputting of the grayscale voltage of positive polarity firstly, and the drive circuit 5 to which the slave function is imparted starts outputting of the grayscale voltage of negative polarity firstly.

Here, a line 66 is a control signal line for shifting an operation of the drive circuit 5-1 having the master function to the drive circuit 5-2 having the slave function.

Figure 9:
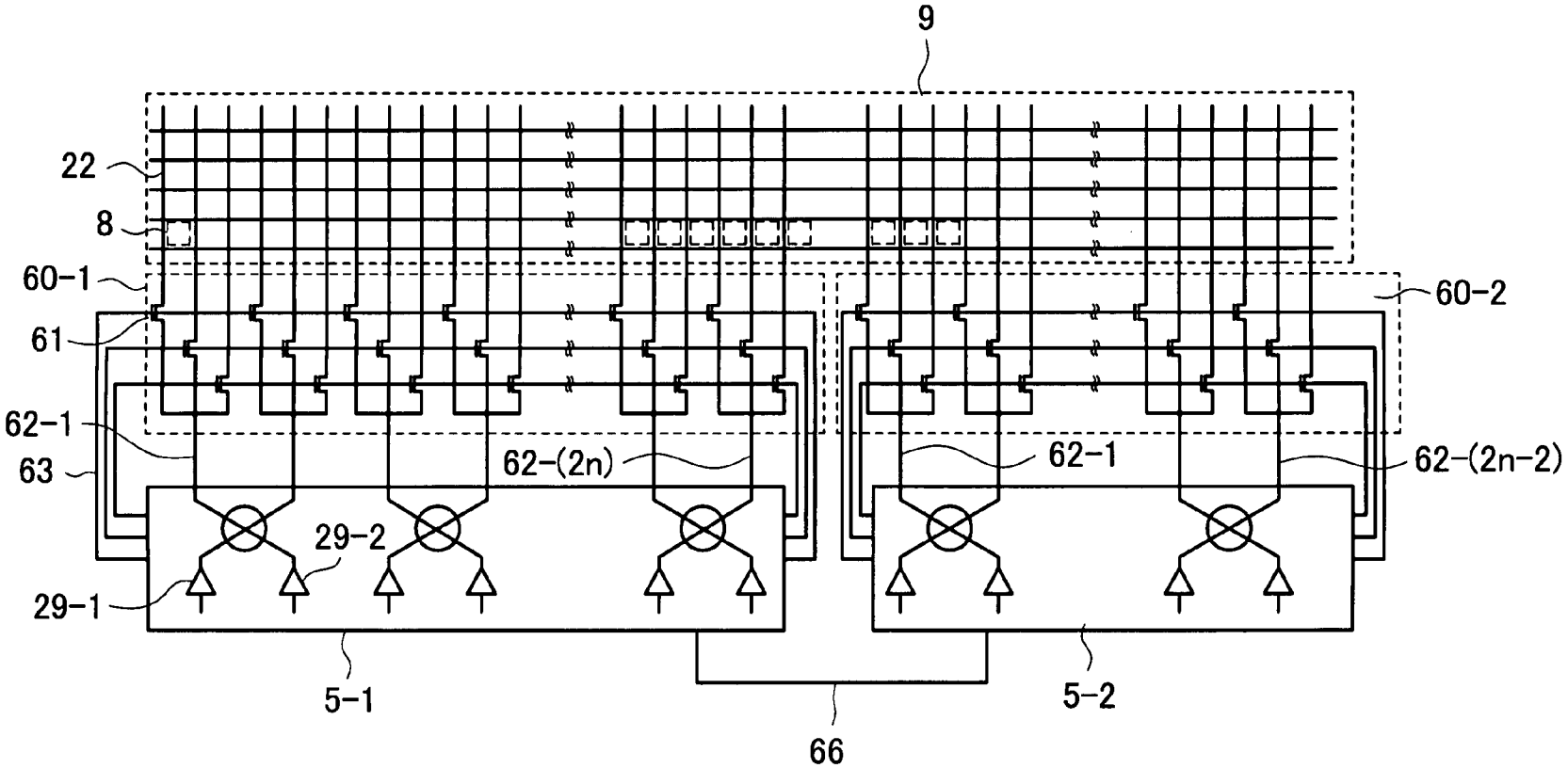
FIG. 9 is a schematic block diagram showing the distribution circuit of the liquid crystal display device of the embodiment according to the present invention.

Next, a case in which the number of relay signal lines 62 differs between the distribution circuit 60-1 and the distribution circuit 60-2 which are obtained by dividing the distribution circuit 60 into two is explained in conjunction with FIG. 9. The number of output terminals of the drive circuit 5-1 is set to 2n, and the number of output terminals of the drive circuit 5-2 is set to 2n−2 and hence, both drive circuits 5-1, 5-2 have the even-numbered outputs. Here, the master function is imparted to the drive circuit 5-1, and the slave function is imparted to the drive circuit 5-2 via the control signal line 66.

Figure 10:
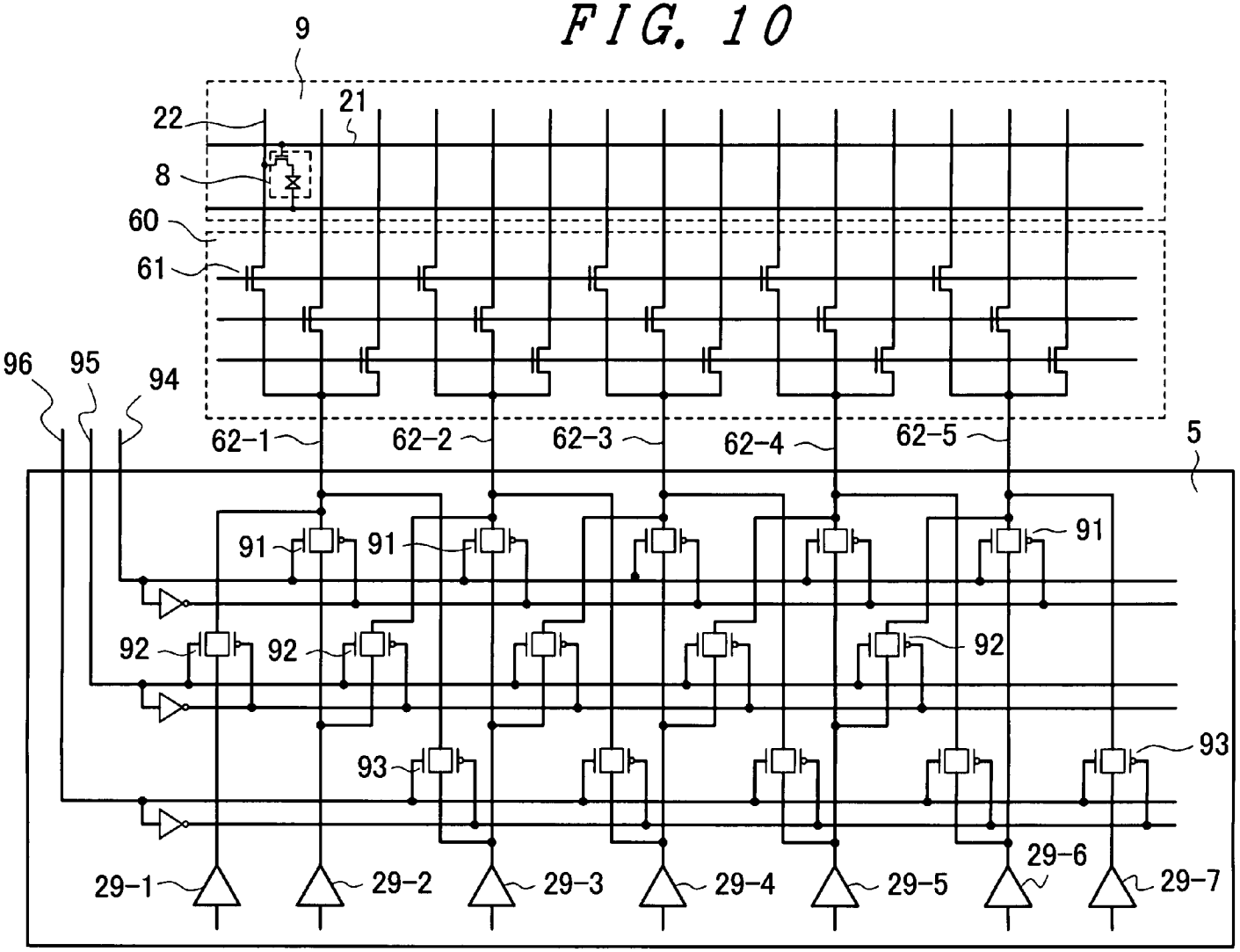
FIG. 10 is a schematic block diagram showing the distribution circuit of the liquid crystal display device of the embodiment according to the present invention.

Next, FIG. 10 shows a drive circuit 5 which can cope with outputting of odd-numbered voltages and bidirectional shifting. In the drawing, output amplifiers 29-1, 29-3, 29-5 and 29-7 are each formed of a low withstand-voltage output amplifier, and output amplifiers 29-2, 29-4 and 29-6 are each formed of a high withstand-voltage output amplifier.

When a High signal is outputted to the control signal line 94 and an analogue switch 91 assumes an ON state, an output voltage of the high withstand-voltage output amplifier 29-2 is supplied to the signal line 62-1. In the same manner, when the analogue switch 91 assumes an ON state, an output voltage of the low voltage output amplifier 29-3 is supplied to the signal line 62-2.

Next, when a High signal is outputted to the control signal line 95, the analogue switch 92 assumes an ON state and hence, an output voltage of the low withstand-voltage output amplifier 29-1 is supplied to the signal line 62-1, and an output voltage of the high withstand-voltage output amplifier 29-2 is supplied to the signal line 62-2.

Next, when a High signal is outputted to the control signal line 96, an analogue switch 93 assumes an ON state and hence, an output voltage of the low withstand-voltage output amplifier 29-3 is outputted to the signal line 62-1.

The drive circuit 5 shown in FIG. 10 can cope with outputting of odd-numbered voltages and bidirectional shifting as follows. When the grayscale voltage of positive polarity outputted from the high withstand-voltage output amplifier 29-2 is supplied to the relay signal line 62-1 and the grayscale voltage of negative polarity outputted from the low withstand-voltage output amplifier 29-3 is supplied to the relay signal line 62-2, the control signal 94 is set to a High signal. Subsequently, when the grayscale voltage of negative polarity outputted from the low withstand-voltage output amplifier 29-1 is supplied to the relay signal line 62-1 and the grayscale voltage of positive polarity outputted from the high withstand-voltage output amplifier 29-2 is supplied to the relay signal line 62-2, the control signal 95 is set to a High signal.

Further, when the grayscale voltage of positive polarity outputted from the high withstand-voltage output amplifier 29-2 is supplied to the relay signal line 62-1 and the grayscale voltage of negative polarity outputted from the low withstand-voltage output amplifier 29-3 is supplied to the relay signal line 62-2, the control signal 94 is set to a High signal. Subsequently, when the grayscale voltage of negative polarity outputted from the low withstand-voltage output amplifier 29-3 is supplied to the relay signal line 62-1 and the grayscale voltage of positive polarity outputted from the high withstand-voltage output amplifier 29-4 is supplied to the relay signal line 62-2, the control signal 96 is set to a High signal.

In this manner, by providing analogue switches 91, 92 and 93 to the drive circuit 5, the drive circuit 5 can cope with the case in which display data is selected in order from the low withstand-voltage output amplifier 29-1 to the high withstand-voltage output amplifier 29-2 and the case in which display data is selected in order from the low withstand-voltage output amplifier 29-7 to the high withstand-voltage output amplifier 29-6.

Figure 11:
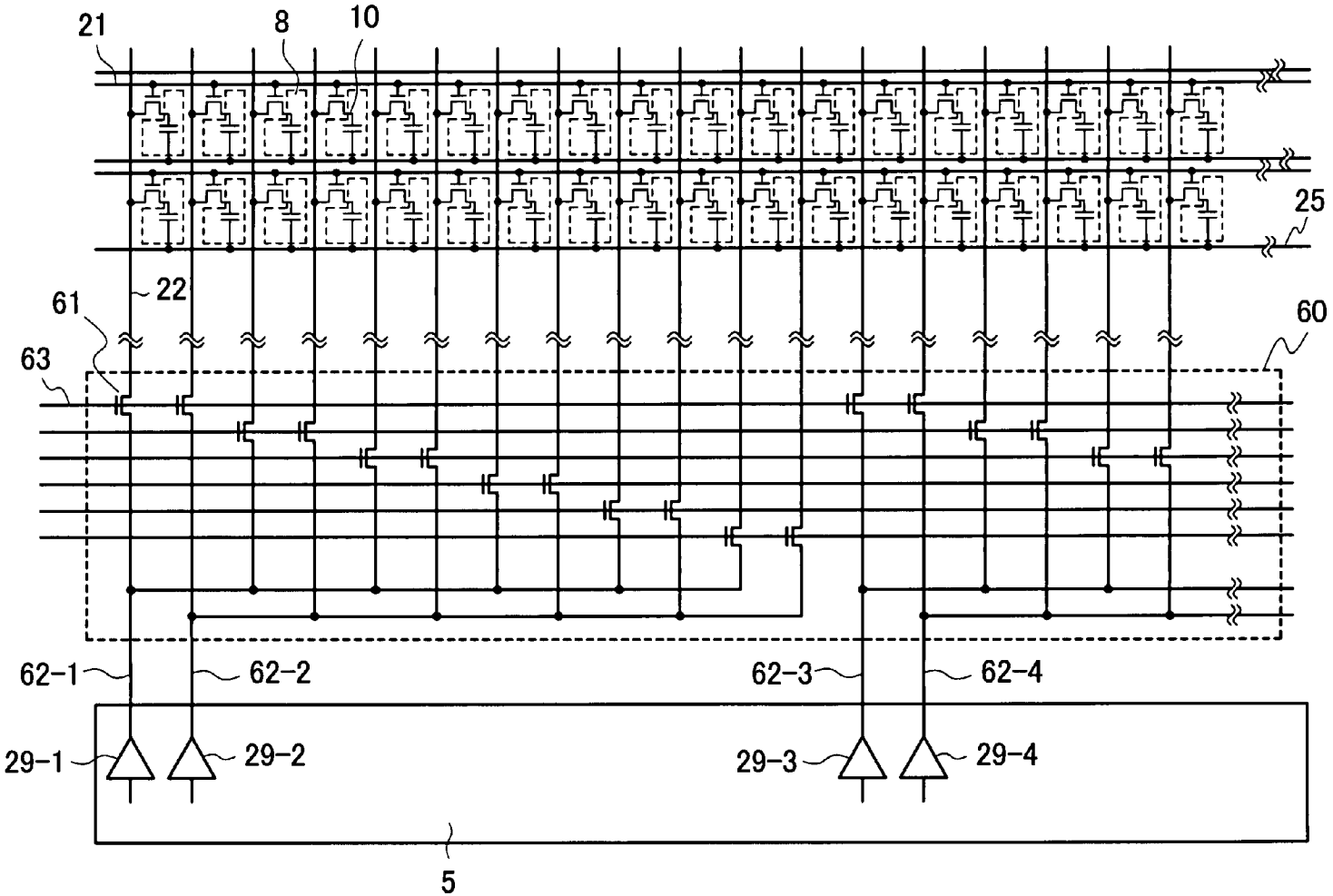
FIG. 11 is a schematic block diagram showing the distribution circuit of the liquid crystal display device of the embodiment according to the present invention.

Next, FIG. 11 shows the constitution which allows the distribution circuit 60 to distribute video signals to six video signal lines 22. A signal from the high voltage output amplifier 29-2 and a signal from the low voltage output amplifier 29-1 are alternately outputted from the drive circuit 5 and hence, it is impossible to distribute the signal to the even-numbered video signal lines. Accordingly, the output of the high withstand-voltage output amplifier 29-2 and the output of the low withstand-voltage output amplifier 29-1 are alternately inputted to the distribution circuit 60.

In a circuit shown in FIG. 11, a relay signal line 62-1 and a relay signal line 62-2 intersect each other on a TFT substrate 2, and these signal lines are formed of a two-layered conductive film with an insulation film sandwiched therebetween.

Figure 12:
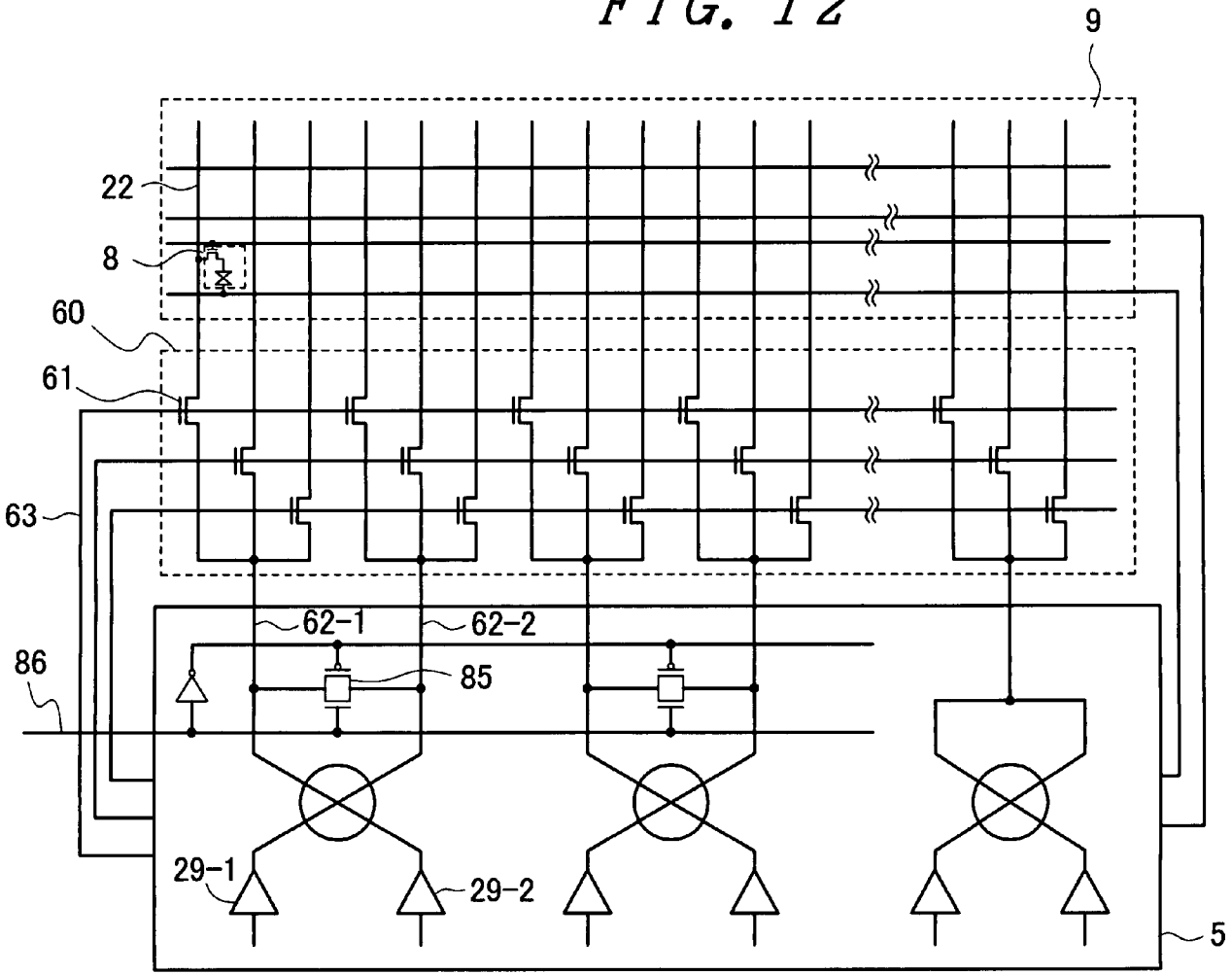
FIG. 12 is a schematic block diagram showing an equalizer circuit of the liquid crystal display device of the embodiment according to the present invention.

Next, FIG. 12 shows the constitution in which the output of the high withstand-voltage output amplifier 29-2 and the output of the low withstand-voltage output amplifier 29-1 are short-circuited by an analogue switch 85 thus equalizing the output voltages of the output amplifiers.

A switching element 10 of a pixel portion 8 is brought into an OFF state during a retrace period, and the relay signal line 62-1 and the relay signal line 62-2 are short-circuited by the analogue switch 85 using a control signal line 86. Since the relay signal lines 62-1 and the relay signal line 62-2 have the opposite polarities, a charge moves between the relay signal lines 62-1 and 62-2 thus acquiring effective power saving.

Figure 13:
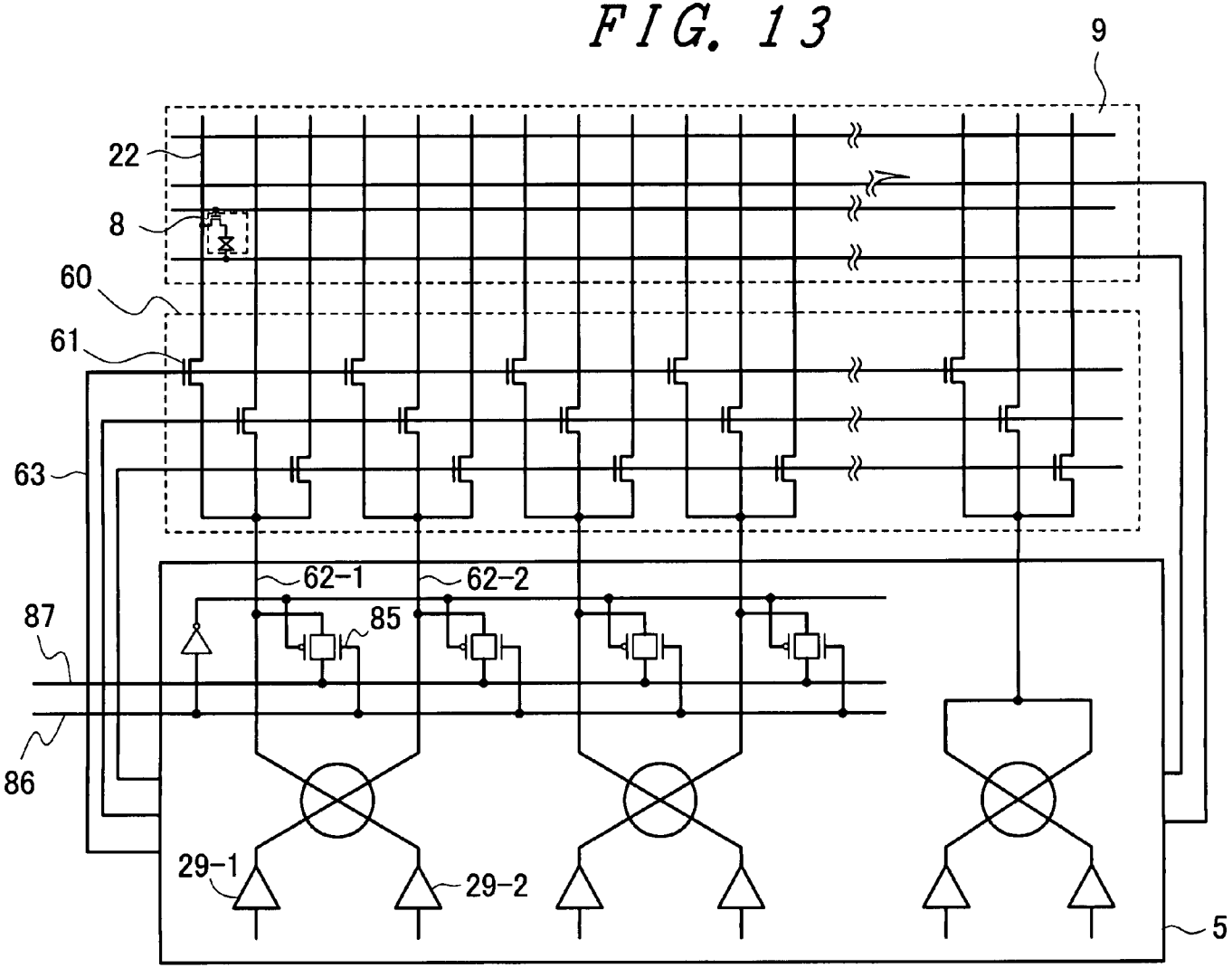
FIG. 13 is a schematic block diagram showing an equalizer circuit of the liquid crystal display device of the embodiment according to the present invention.

Next, FIG. 13 shows the constitution in which the output of the high withstand-voltage output amplifier 29-2 and the output of the low withstand-voltage output amplifier 29-1 are short-circuited to a ground potential line 87 by the analogue switch 85 thus equalizing the potential of a video signal line 22 to a GND potential.

A switching element 10 of a pixel portion 8 is brought into an OFF state during a retrace period, and the relay signal line 62-1 and the relay signal line 62-2 are short-circuited to the ground potential line 87 by the analogue switch 85. By setting the potentials of the relay signal lines 62-1 and 62-2 to a ground potential, compared to the case shown in FIG. 2, it is possible to decrease respective withstand voltages of the high withstand-voltage output amplifier 29-2 and the low withstand-voltage output amplifier 29-1. Further, the relay signal lines 62-1 and 62-2 have the opposite polarities and hence, a charge can be supplied by way of the ground potential line 87 thus acquiring effective power saving.

The equalizer circuit 80 shown in FIG. 1 and FIG. 2 is provided for short-circuiting video signal lines 22 having opposite polarities in the same manner.

Although the invention made by the inventors of the present invention has been explained specifically based on the embodiments heretofore, it is needless to say that the present invention is not limited by such embodiments and various modifications can be made without departing from the gist of the present invention.

What is claimed is:

1. A liquid crystal display device comprising:

a liquid crystal display panel; and first and second drive circuits which are configured to drive the liquid crystal display panel, wherein a first distribution circuit is configured to distribute video signals outputted from the first drive circuit to a plurality of video signal lines arranged on the liquid crystal display panel and formed on the liquid crystal display panel, a second distribution circuit is configured to distribute video signals outputted from the second drive circuit to a plurality of video signal lines arranged on the liquid crystal display panel and formed on the liquid crystal display panel, the first distribution circuit is configured to be controlled in response to a first control signal outputted from the first drive circuit, the second distribution circuit is configured to be controlled in response to a second control signal outputted from the second drive circuit, the first drive circuit includes a plurality of video signal output terminals which are configured to output the video signals, first and second control signal output terminals which are formed with the plurality of video signal output terminals sandwiched therebetween and are configured to output the control signals, the second drive circuit includes a plurality of video signal output terminals which are configured to output the video signals, third and fourth control signal output terminals which are formed with the plurality of video signal output terminals sandwiched therebetween and are configured to output the control signals, a master/slave control signal line is connected between the first drive circuit and the second drive circuit for imparting a slave function of the second drive circuit, the first drive circuit starts outputting the grayscale voltage of positive polarity, the second drive circuit starts outputting the grayscale voltage of negative polarity, and the first distribution circuit has an input terminal which connects to two video signal output terminals of the first drive circuit.

2. A liquid crystal display device according to claim 1, wherein a scanning signal line drive circuit is formed on the liquid crystal display panel, and the drive circuit includes scanning signal output terminals which are connected to the scanning signal line drive circuit outside the control signal output terminals.

3. A liquid crystal display device according to claim 1, wherein the number of the video signal output terminals sandwiched between the first control signal output terminal and the third control signal output terminal is an even number.

4. A liquid crystal display device according to claim 1, wherein said plurality of video signal output terminals which are arranged adjacent to each other are configured to output video signals having polarities opposite to each other therefrom.

5. A liquid crystal display device comprising:

a first substrate;

a second substrate;

liquid crystal composition which is sandwiched between the first substrate and the second substrate;

a plurality of pixel electrodes which are formed on the first substrate;

a plurality of video signal lines which are configured to supply video signals to the pixel electrodes;

first and second drive circuits which are mounted on the first substrate and is configured to output the video signals from video signal output terminals; and first and second distribution circuits which are formed on the first substrate and is configured to distribute the video signals outputted from the drive circuit to the plurality of video signal lines arranged on a liquid crystal display panel, wherein the first distribution circuit is configured to be controlled in response to a first control signal outputted from the first drive circuit, the second distribution circuit is configured to be controlled in response to a second control signal outputted from the second drive circuit, the first drive circuit and the first distribution circuit are connected to each other by a plurality of relay signal lines which relay the video signals, the second drive circuit and the second distribution circuit are connected to each other by a plurality of relay signal lines which relay the video signals, the relay signal lines are connected to the drive circuit via the video signal output terminals, the number of the relay signal lines which are connected to the video signal output terminals is an even number, the number of the relay signal lines which are connected to the distribution circuit is an odd number, a master/slave control signal line is connected between the first drive circuit and the second drive circuit for imparting a slave function of the second drive circuit, and the first distribution circuit has an input terminal which connects to two video signal output terminals of the first drive circuit.

6. A liquid crystal display device according to claim 5, wherein control signal output terminals from which the control signals are outputted are arranged outside the video signal output terminals.

7. A liquid crystal display device according to claim 5, wherein control signal output terminals from which the control signals are outputted are arranged outside the video signal output terminals, and a scanning signal line drive circuit is formed on the liquid crystal display panel, and the first drive circuit includes scanning signal output terminals which are connected to the scanning signal line drive circuit outside the control signal output terminals.

8. A liquid crystal display device according to claim 5, wherein video signals having polarities opposite to each other are outputted to said two relay signal lines which are arranged adjacent to each other.

9. A liquid crystal display device comprising:

a first substrate;

a second substrate;

liquid crystal composition which is sandwiched between the first substrate and the second substrate;

a plurality of pixel electrodes which are formed on the first substrate;

a plurality of video signal lines which are configured to supply video signals to the pixel electrodes;

a first drive circuit and a second drive circuit which are mounted on the first substrate and are configured to output the video signal from video signal output terminals;

a first distribution circuit which is formed on the first substrate and is configured to distribute the video signals outputted from the first drive circuit to the plurality of video signal lines arranged on a liquid crystal display panel; and a second distribution circuit which is formed on the first substrate and is configured to distribute the video signals outputted from the second drive circuit to the plurality of video signal lines arranged on the liquid crystal display panel, wherein the first distribution circuit is configured to be controlled in response to a first control signal outputted from the first drive circuit, the second distribution circuit is configured to be controlled in response to a second control signal outputted from the second drive circuit, the first drive circuit and the first distribution circuit are connected to each other by a plurality of relay signal lines and the second drive circuit and the second distribution circuit are connected to each other by a plurality of relay signal lines, the plurality of relay signal lines relay the video signals, the relay signal lines are connected to the first and second drive circuits via the video signal output terminals, the number of the relay signal lines which are connected to the video signal output terminals provided to the first drive circuit is an even number, the number of the relay signal lines which are connected to the first distribution circuit is an odd number, polarity of the $n^{th}$ relay signal line, n being an odd number, which is connected to the first distribution circuit and polarity of the $m^{th}$ relay signal line, m being an odd number, which is connected to the second distribution circuit are set opposite to each other, a master/slave control signal line is connected between the first drive circuit and the second drive circuit for imparting a slave function of the second drive circuit, and the first distribution circuit has an input terminal which connects to two video signal output terminals of the first drive circuit.

10. A liquid crystal display device according to claim 9, wherein the control signal output terminals from which the control signals are outputted are arranged outside the video signal output terminals.

11. A liquid crystal display device according to claim 9, wherein the control signal output terminals from which the control signals are outputted are arranged outside the video signal output terminals, and a scanning signal line drive circuit is formed on the liquid crystal display panel, and the first drive circuit includes scanning signal output terminals which are connected to the scanning signal line drive circuit outside the control signal output terminals.

* * * * *